United States Patent [19]

Walz

[11] 4,247,803

[45] Jan. 27, 1981

[54] TRIGGER PULSE GENERATOR FOR GAS DISCHARGE LAMPS

[76] Inventor: Alfred Walz, Am Kurzarm 7, Emmendingen, Fed. Rep. of Germany, D-7830

[21] Appl. No.: 30,466

[22] Filed: Apr. 16, 1979

[30] Foreign Application Priority Data

Apr. 18, 1978 [DE] Fed. Rep. of Germany ..... 2816753

[51] Int. Cl.[3] ..... H05B 37/00; H05B 41/14; H05B 41/18

[52] U.S. Cl. ..... 315/289; 315/106; 315/DIG. 5

[58] Field of Search ..... 315/289, 101, 106, 360, 315/DIG. 5

[56] References Cited

U.S. PATENT DOCUMENTS 4,152,628 5/1979 Rottier ..... 315/106

*Primary Examiner*—Alfred E. Smith
*Assistant Examiner*—Thomas P. O'Hare
*Attorney, Agent, or Firm*—Browdy and Neimark

[57] ABSTRACT

An ignition trigger circuit for luminous and fluorescent discharge tubes, especially for cold electrode tubes. The ignition pulses are generated by placing across the gas discharge tube a relay-activated switch. The relay windings are connected in series with a rectifying diode and a capacitor across the A.C. power source. When a charging current flows into the capacitor, the relay windings are actuated at each A.C. cycle. By suitable choice of the electrical dimensions, the charging phase of the capacitor may be extended over several A.C. cycles, thereby causing repeated actuations of the relay and closures of the switch. Once the charging current falls below the holding current of the relay, the short-circuiting switch stays open permanently. A discharge resistor is provided to return the circuit to its initial state after being removed from the A.C. current source.

11 Claims, 8 Drawing Figures

FIG.5
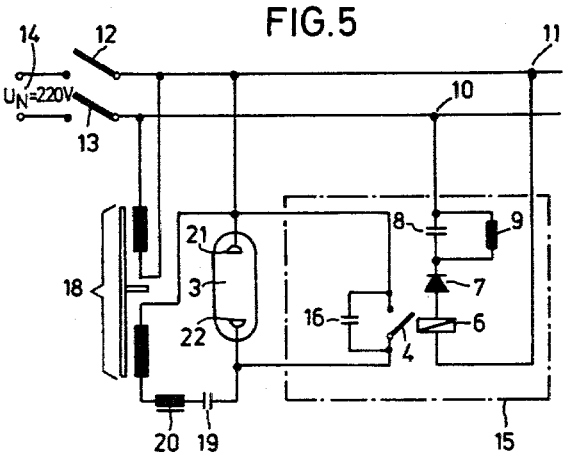
FIG.8
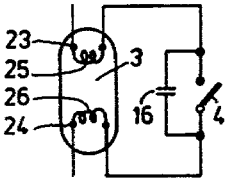
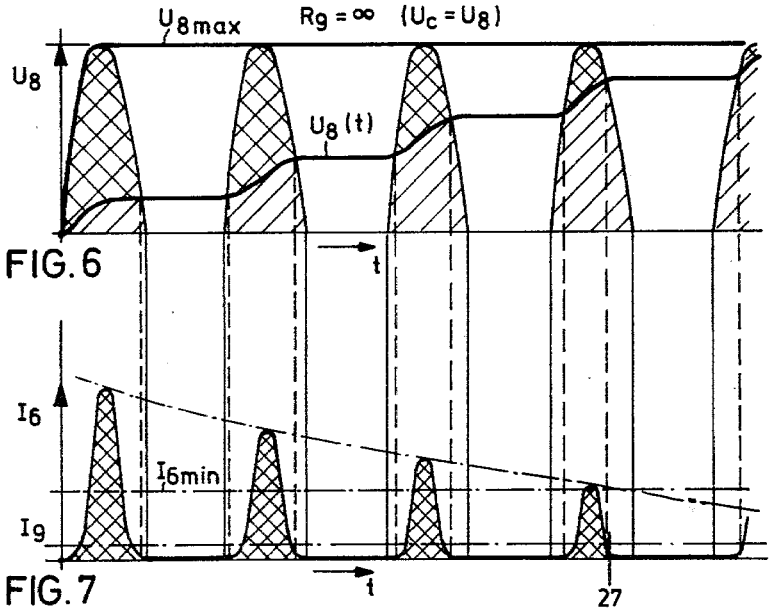
FIG.6
FIG.7

TRIGGER PULSE GENERATOR FOR GAS DISCHARGE LAMPS

FIELD OF THE INVENTION

The invention relates to gas discharge lamps, of both low and high pressure type. More particularly, the invention relates to a circuit assembly which generates high voltage trigger pulses for initiating the discharge in the gas discharge lamp. The generation of the starting pulses is based on the succession of closures and openings of the electric circuit by means of mechanical or electronic contacts which are connected in parallel with the discharge lamp.

BACKGROUND OF THE INVENTION

In order to initiate the start-up of low pressure luminous tubes (fluoroescent tubes) it has been customary to provide so-called glow starters which perform an automatic sequence of functions which result in the closure and interruption of the electrical contact of the tube. These starters also preheat the customary thermionic twisted filaments in the tube, thereby substantially reducing the voltage peak necessary for ignition of the gas discharge, for example to a region between 400 and approximately 2,000 volts. It is generally necessary for the known starters to perform a number of different switch closing and opening cycles which follow one another at periods of approximately 1 second. Only if the opening of the contact happens to occur at or near the peak of the generally sinusoidal current does a single switch opening suffice in order to initiate ignition of the gas discharge lamp. After ignition has occurred, the glow starter terminates its contact opening and closing function because the voltage required for the operation is equal to the full line voltage (220 volts in Europe, 110 volts in the U.S.) whereas the operating voltage of the discharge lamp is only approximately half the nominal line voltage, i.e., 110 volts and 55 volts, respectively.

OBJECT AND SUMMARY OF THE INVENTION

It is a principal object of the present invention to provide an electrical circuit assembly for generating ignition voltage pulses for a gas discharge lamp which performs the required ignition in cold electrode tubes without preheating and even when the ambient temperature is low.

This and other objects are achieved according to the present invention by providing a relay-actuated short-circuiting switch and by connecting in series with the windings of the relay a rectifier and a capacitor. Advantageously, the rectifier is one or more silicon diodes.

A further feature of the invention is to connect a discharging resistor in parallel with the relay capacitor. The discharge resistor is designed to provide substantially complete discharge of the capacitor in a period of time of approximately 1 second so as to prepare the circuit assembly for a new ignition sequence.

The operation of the circuit according to the invention is still further improved if a second capacitor is connected in parallel with the movable switch contact of the relay. This second capacitor serves principally for spark suppression but it also promotes the ignition when it is suitably dimensioned.

An advantageous and suitable feature of the invention is the use of sintered electrodes for the gas discharge lamp which is being started by the circuit according to the invention.

However, it is also possible according to the invention, to start a discharge lamp having glow electrodes.

In one preferred embodiment of the invention, the electrical properties of the relay windings and the associated relay capacitor are matched so as to extend the charging of the capacitor over a substantial number of cycles of the alternating current.

Still further advantages and features of the invention will emerge from a description of a number of preferred embodiments which relate to the drawing.

DESCRIPTION OF THE DRAWING

FIG. 5 is a second variant of the embodiment of FIG. 3;

FIG. 6 is a diagram illustrating the voltage across the relay capacitor as a function of time, and FIG. 7 is a diagram illustrating the current through the relay windings as a function of time; and FIG. 8 is an illustration of a gas discharge tube having twisted filament electrodes in association with the invention.

DESCRIPTION OF THE PREFERRED EMBODIMENTS

Figure 1:
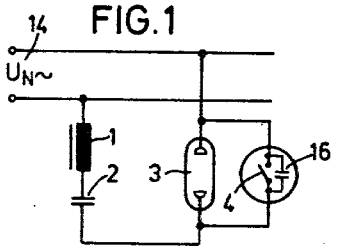
FIG. 1 is a basic circuit diagram of a luminous discharge tube and associated circuit elements.
Figure 2:
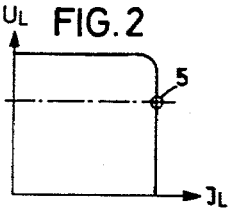
FIG. 2 is a voltage versus current diagram for a luminous tube.

FIG. 1 is an illustration of the overall circuit of a gas discharge tube 3 in parallel with which is connected a customary starting circuit, for example a glow starter. Connected in series with the gas discharge tube 3 across a source of alternating current 14 is an inductor 1 and a capacitance 2. By suitable choice of the electrical properties of the inductance 1 and the capacitor 2, the lamp circuit exhibits resonance effects which tend to hold the operating current through the tube substantially constant as is illustrated in the voltage versus current curve of FIG. 2, where $U_L$ represents the voltage across the lamp 3 and $I_L$ is the lamp current. The point 5 illustrates a possible point of operation.

The ignition circuit according to the present invention is especially useful and suitable in association with a constant current circuit of this type and will thus be described in detail with reference to a known stabilizing constant current circuit.

Figure 3:
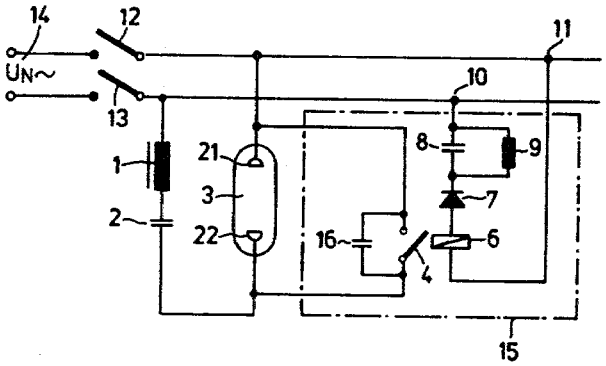
FIG. 3 is a circuit diagram of a first exemplary embodiment of the invention.

The first embodiment of the features of the present invention is illustrated in FIG. 3 where the entire system is shown to be connected to the alternating current source by a double pole switch 12, 13. The gas discharge lamp 3 has two cold electrodes (sintered electrodes) 21, 22. A short-circuiting switch 4 is actuated by relay windings 6 which are connected across the A.C. line in series with a rectifying diode 7 and a capacitor 8 at points 10 and 11. Preferably, the diode 7 is a silicon diode.

By comparison with a known glow starter, the circuit according to the invention as illustrated in FIG. 3 performs a substantially faster ignition of the gas discharge lamp 3 due to the fact that the time which elapses between successive openings and closings of the contact 4 is only half the period of the alternating current, i.e., 1/100 second for a frequency of 50 Hz. Accordingly, the probability that one of the contact openings will occur in the vicinity of a current maximum during a time period of approximately 1 second is very high and such an event will produce a particularly high voltage peak which tends to insure ignition. Normally, the occurrence of a switch opening near the current maximum will occur in fractions of a second resulting in substantially immediate ignition. The voltage peaks are sufficiently high (several thousands of volts) that ignition occurs reliably in discharge tubes whose electrodes have no preheating (cold electrodes) 21, 22 and also takes place reliably when the ambient temperatures are very low. This advantageous property of the ignition circuit according to the invention substantially facilitates use of long-life luminous tubes, for example tubes having an average lifetime of over 20,000 hours and equipped with cold starting sintered electrodes which, in operation, become thermionic emitters when the operational current spot produces a local temperature of approximately 1,000° C. Under these conditions, the cold cathode tubes produce the same luminous intensity (Lumen/Watt) as do customary luminous tubes with heated twisted filaments.

In order to permit discharging the relay capacitor 8 in a time period of approximately 1 second, there is connected across the capacitor 8 a resistor 9 of suitable magnitude.

The overall ignition circuit 15 is affected in its operation by a number of parameters, among these are (a) the resistance of the discharge resistor 9;

(b) the electrical dimensions of the relay windings 6, for example the ampere-turns, the inductance and the ohmic resistance, and (c) the response time of the relay armature which is preferably less than approximately 1/50 seconds.

Advantageously, a small capacitor 16 is connected in parallel to the switch 4. The capacitor 16 serves primarily for spark suppression but also promotes tube ignition when it is suitably dimensioned, for example approximately 50–100 pF.

Figure 4:
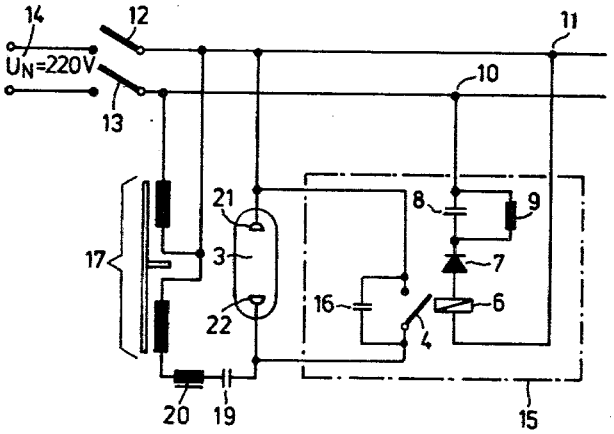
FIG. 4 is a variant of the embodiment of FIG. 3.

A variant of the preferred embodiment according to FIG. 3 is shown in FIG. 4, the only variation being the substitution of a constant current transformer 17 for the inductor 1 and the capacitor 2 of FIG. 3. The constant current transformer 17 generates an idling voltage of approximately 420 V. In order to stabilize the current, the transformer 17 is associated with a choke 20 in series with a capacitor 19.

A variant of the embodiment of FIG. 4 is illustrated in FIG. 5 where a constant current transformer 18 of slightly different construction generates an idling voltage of 990 V.

The constant current transformers 17, 18 serve to stabilize the current through the discharge tube 3. Such stabilizing circuits employing constant current transformers have been described for example in the German Offenlegungsschrift No. 2,642,288. These transformers have separate primary and secondary windings or they have windings connected as in the example of FIG. 4. Such transformers yield secondary voltages substantially higher than the line voltage, for example 440 V for the design of FIG. 4 and 990 V for the circuit of FIG. 5. The manner of operation of the ignition circuit 15 according to the invention will now be discussed with the aid of FIGS. 6 and 7 which illustrate the behavior of the electrical quantities as a function of time.

FIG. 6 is a diagram illustrating the voltage $U_8$ across the capacitor 8. This voltage is seen to be unidirectional due to the rectifying action of the silicon diode 7. The idealized voltage $U_8$ which would occur if all resistances and inductive impedances were assumed negligibly small and the resistor 9 assumed to be infinitely large is shown as a curve terminating in the straight line $U_{8max}$. $U_{8max}$ is equal to $\sqrt{2}U_{eff}$, i.e., $U_{8max}=314$ V for $U_{eff}=220$ V. This voltage will be maintained across the capacitor unless a discharge occurs through the resistor 9. In practice, the relay windings 6 will have a relatively high ohmic resistance and a small inductance and the combination of these properties substantially reduces the charging current $I_6$ so that the complete charging process is extended over a number of periods of the A.C. current. It is a feature of the invention to so choose the electrical values of the capacitor 8 and the relay windings 6 that the charging process of the capacitor 8 extends over a substantial number of periods, for example 10–20 periods of the A.C. current supply.

The charging current $I_6$ flowing through the relay windings 6 is a function of the difference between the voltage $U_8$ (t) and $U_{8max}$. FIG. 7 illustrates that the charging current will be zero for certain times and that the peak of the charging current decreases with each A.C. current cycle. When the current peak falls below the holding current $I_{6min}$ of the relay 6, the armature is released and the switch contacts 4 are opened. Thereafter, only a very small current is permitted to flow through the windings 6, i.e., the discharge current through the resistor 9 whose resistance may be, e.g. 1 MΩ. This small current is substantially below the holding current $I_{6min}$ of the relay 6 and serves to discharge the capacitor 8 in a time span of approximately 1 second.

In actual tests, an ignition circuit according to the invention connected across a 50 Hz A.C. current grid operated satisfactorily with the following electrical values:

Capacitor 8: 4.7–10μF; 350/370 V nominal voltage (electrolytic capacitor)

Discharge resistor 9: 1–2 M Ω

Relay windings 6: approximately 400–700 Ω, response power input 0.35–0.45 W equipped with an electrical contact of the type ECO 40904

Rectifier diode: Type 1 N 4007, 1 Amp., 1000 PIV

The point at which the relay current $I_6$ falls below the holding current $I_{6min}$ is illustrated in FIG. 7 by the numeral 27. Prior to reaching this point, the current causes the contact 4 to open and close in step with the grid frequency, for example 50 or 60 Hz. After the time 27, the relay armature remains stationary and the contact 4 is permanently open.

If the effect of the resistor 9 is imagined to be negligible, the voltage difference between $U_{8max}$ and $U_C$ will be as shown cross-hatched in FIG. 6. A charging current through the capacitor 8 can flow only at those times. Once the peak value of the current $I_6$ falls below the value $I_{6min}$, the tube ignition pulses no longer take place. After the power switches 12, 13 have been opened, the resistor 9 is discharged in a time period of between 1 and 2 seconds.

The gas discharge lamps illustrated in FIGS. 1, 3, 4 and 5 are cold cathode tubes 21, 22. However, the invention is also usable in gas discharge tubes 3 having preheatable filament electrodes 25, 26 such as illustrated in FIG. 8. When such cathodes are used, they may be preheated during the ignition pulse times, thereby further promoting ignition. Without any change of the physical principles of the invention, the single rectifier diode 7 may be replaced by a full-wave rectifier bridge. The small increase in cost is offset by a doubling of the number of ignition pulses, (e.g. from 50–100 pulses per second in a 50 Hz grid) and may be advantageous in some cases.

The invention is not limited to the foregoing exemplary embodiments and variants, rather it also encompasses other embodiments and variants thereof which fall into the field of competence of the person skilled in the art. The invention also includes partial and sub-combinations of the characteristics and methods described or illustrated above.

I claim:

1. An improved arrangement for starting a low and high pressure gas discharge tube which includes inductive current stabilizing means in series with the gas discharge tube and a trigger circuit for the gas discharge tube, the improvement wherein said trigger circuit comprises:

a switch having its contact electrically connected directly across said gas discharge tube for selectably short-circuiting said tube; and relay means including a winding parallel to said gas discharge tube and said stabilizing means for actuating said switch, said winding of said relay means being in series connection with a rectifier and a capacitor and said series connection being connected directly to a source of alternating electrical current.

2. An improved arrangement for starting a low and high pressure gas discharge tube according to claim 1, wherein said rectifier is a silicon diode.

3. An improved arrangement for starting a low and high pressure gas discharge tube according to claims 1 or 2, further comprising a discharge resistor connected across said capacitor.

4. An improved arrangement for starting a low and high pressure gas discharge tube according to claim 1, further comprising a second capacitor connected in parallel with the contact of said switch.

5. An improved arrangement for starting a low and high pressure gas discharge tube according to claim 1, wherein said gas discharge tube is equipped with sintered cold electrodes.

6. An improved arrangement for starting a low and high pressure gas discharge tube according to claim 1, wherein said gas discharge tube is equipped with thermionic electrodes.

7. An improved arrangement for starting a low and high pressure gas discharge tube according to claim 1, wherein the capacitance of said capacitor and the electrical properties of said relay means are matched such that the charging time constant of said capacitor is equal to at least a plurality of cyclic periods of said alternating electrical current.

8. An improved arrangement for starting a low and high pressure gas discharge tube according to claim 1, wherein said rectifier is a full-wave rectifier bridge whose individual rectifying elements are silicon diodes.

9. An improved arrangement for starting a low and high pressure gas discharge tube according to claim 1, wherein said inductive current stabilizing means comprises an inductor and a further capacitor connected in series with one another and said gas discharge tube across said source of alternating current.

10. An improved arrangement for starting a low and high pressure gas discharge tube according to claim 9, wherein said inductor and said further capacitor are coupled to said source of alternating current via an autotransformer.

11. An improved arrangement for starting a low and high pressure gas discharge tube according to claim 9, wherein said inductor and said further capacitor are coupled to said source of alternating current via a transformer.

* * * * *